US005511938A

United States Patent [19]

Courtade Pedrero

[11] Patent Number: 5,511,938

[45] Date of Patent: Apr. 30, 1996

[54] SUCTION DEVICE FOR PUMPING EQUIPMENT IN DEEP WATER WELLS

[75] Inventor: Enrique Courtade Pedrero, Narciso Mendoza 106, Fracc Bahia Ensenada, Mexico, 22880

[73] Assignee: Enrique Courtade Pedrero, San Ysidro, Calif.

[21] Appl. No.: 250,515

[22] Filed: May 26, 1994

Related U.S. Application Data

[63] Continuation-in-part of Ser. No. 134,598, Oct. 12, 1993, abandoned.

[51] Int. Cl.[6] ..... F01D 25/00

[52] U.S. Cl. ..... 415/121.2

[58] Field of Search ..... 415/121.2

[56] References Cited

U.S. PATENT DOCUMENTS

| | | | |
|---|---|---|---|
| 1,872,538 | 8/1932 | Weis | 415/121.2 |
| 3,163,229 | 12/1964 | Salisbury | 415/121.2 |
| 3,606,567 | 9/1971 | Stahle | 415/121.2 |
| 3,620,638 | 11/1971 | Kaye et al. | 415/121.2 |
| 3,972,647 | 8/1976 | Niedermeyer | 415/121.2 |
| 4,135,852 | 1/1979 | Archibald | 415/121.2 |

*Primary Examiner*—John T. Kwon

[57] ABSTRACT

An improvement for deep water well pumping equipment which comprises a suction tube extending down from the intake port of the pump equipment to the bottom of the well. The suction tube has a series of apertures spaced along and around its surface. Each aperture can be formed as a water guiding admissor to direct the flow toward the intake port. The spacing of the admissors is calculated to provide a substantially uniform flow of water through the admissors into the suction tube. This uniform flow reduces the turbulences that normally develop near the intake port and thereby reduces the amount of silt entering the pumping apparatus. This uniform flow also draws water from the surrounding aquiferous layer in a more lateral fashion, thereby reducing the depth of the dynamic pumping level and increasing pump efficiency.

4 Claims, 7 Drawing Sheets

SUCTION DEVICE FOR PUMPING EQUIPMENT IN DEEP WATER WELLS

PRIOR APPLICATION

This application is a continuation-in-part of Ser. No, 08/134,598 filed Oct. 12, 1993, now abandoned.

FIELD OF THE INVENTION

This invention relates to fluid pumps and associated suction equipment and more specifically to pumping installations for aquifer-type deep water wells.

BACKGROUND OF THE INVENTION

Vertical turbine pumps for deep water wells are well known and have been applied thoroughly in conventional pumping systems. FIG. 1 shows a typical prior art turbine driven deep water well pumping installation. The installation comprises an elongated cylindrical hole 2 extending from an open end at the surface 3 down into the ground 4, terminating at a closed end 5. The well penetrates the natural water table or phreatic level 6 of at least one aquiferous geological formation. A tubular casing 7 is inserted into the well to define a pumping chamber 8 and to prevent the well wall 9 from collapsing. The casing is made of steel, fiberglass, plastic such as polyvinyl chloride (PVC), polyethylene, or acrylonitrile butadiene styrene (ABS), or some other strong durable material. The casing is generally perforated from the phreatic level down to the well bottom to allow passage of water through to the inside of the casing. Gravel 10 is poured to fill in the annular gap between the well wall 9 and the casing 7. The gravel acts as a filter to prevent granular materials existing in the surrounding geologic strata from entering the casing. Naturally, the gravel is coarser than the perforations through the casing. A tube or pump column 11 through which water will be pumped out is inserted into the casing and extended down a distance beyond the phreatic level.

Typically, a deep water well pumping installation employs a turbine pump to extract the water from within the well. The turbine pump includes a motor 12 which is usually situated above ground. The motor drives a long drive shaft 13 which extends down through the tube, typically terminating a distance below the phreatic level with a set of bowls and impellers 15. Many impeller designs are available. Usually, the shaft is rotatively secured by one or more bearings 16 positioned within the tube made of materials such as rubber or bronze. These structures are also referred to as spiders or bushings. The pump can be lubricated by water or oil. A typical speed for the impellers is around 1800 rpm. The bottom of the tube 11 terminates just above the set of impeller bowls which are located between the bottom end of the pump column and the intake or suction port 17.

During pumping, the spinning impellers force water up the tube and out through a discharge head pipe 18. Water is drawn from the aquifer. Water existing in the surrounding formation can be said to converge toward the intake port through a series of successively smaller concentric cylindrical surfaces centered at the intake port. If the flow is constant through each cylinder, water velocity must increase as it gets closer to the port. This increase in velocity tends to agitate the gravel filter and the surrounding geological formation to such a degree that poorly cemented particles such as sand, silt and grit are dislodged and become suspended in the flow. This abrasive flow causes removal of material from the geological formation provoking the creation of caves which can collapse and damage part or all of the well and its equipment. In addition, the high velocity flow near the intake port erodes the casing. As the abrasive water travels up the tube, it erodes the impellers, the bearings, the shaft and other pump elements. The end result is regular costly maintenance to replace worn structures and a reduction in the useful lifetime of the well.

Another hydrodynamic result of pumping is a drop in the phreatic water level in the region surrounding the well. The normally flat water table takes on a shape closely resembling an inverted cone 19 whose central axis coincides with the axis of the well. This forms what is called the dynamic or pumping level 20 which is significantly below the original natural water level. Since the gravel is more permeable than the surrounding geologic formation, water tends to flow through the gravel rather than the formation. Hence, water removed by the pump tends to be replaced most quickly from above rather than laterally.

The drop of the phreatic level becoming the dynamic level lowers the pumping depth and exacerbates the problems of reduced efficiency. First, the well may have to be dug deeper to accommodate the drop in phreatic level since the intake port must be situated below the lowest depth the dynamic level will attain. Second, this causes a proportional increase in the amount of energy necessary to pump out a given amount of water. This reduces well efficiency and can even reduce the output of the well over a given time. Lastly, the speed of the water entering the well just below the dynamic water level creates additional turbulence which removes particles and minerals causing greater erosion of the casing and reducing the lifetime of the well.

Another common problem with aquifers is that part of the geological formation may contain contaminants such as salt or other minerals.

It is desirable therefore to have a pump which reduces the depth of the dynamic pumping level, reduces the amount of suspended solids in the water, and can select which aquiferous layers are to be exploited.

SUMMARY OF THE INVENTION

The principal and secondary objects of this invention are to provide an apparatus which inexpensively increases the efficiency of deep water well pumping equipment while increasing the useful lifetime of the equipment and mechanisms involved by reducing the pumping depth.

It is a further object of this invention to provide an apparatus for selectively drawing water from certain depths in an aquiferous region, while excluding other contaminated depths.

These and other objects are achieved by extending a suction device down from the intake port of the pump to the bottom of the well. This suction device comprises an oblong tubular conduit having a series of apertures spaced around the surface of the conduit and along its length. Each aperture is in the form of a water guiding admissor for directing the flow toward the intake port. The combined flow through the admissors is substantially equal to the flow through the intake port or flow rate required by the pump. The spacing of the admissors is calculated to provide a substantially uniform flow of water through the admissors into the suction device. This slower, more uniform flow, as a result of the more evenly distributed suction reduces the turbulences that normally develop at the intake port and thereby reduces the amount of silt entering the pumping apparatus. In addition, this more uniform flow also draws water from the surrounding aquiferous layer in a more lateral fashion, thereby reducing the depth of the dynamic pumping level and making a more integral use of the aquifer.

Selectivity of aquifer layers is achieved by omitting admissors at depths where contaminated water is known to exist.

The admissors are designed to reduce friction and direct the flow of water through the admissor toward the pump intake. This further reduces drag on the pump, increasing efficiency.

Two or more lengths of conduit may be attached together to form a suction device of extended length.

BRIEF DESCRIPTION OF THE DRAWING

FIG. 10 is a cross-sectional and cut-away view of a portion of a deep water well where the suction device has an absence of admissors at a depth where the water is contaminated.

DESCRIPTION OF THE PREFERRED EMBODIMENT OF THE INVENTION

Figure 1:
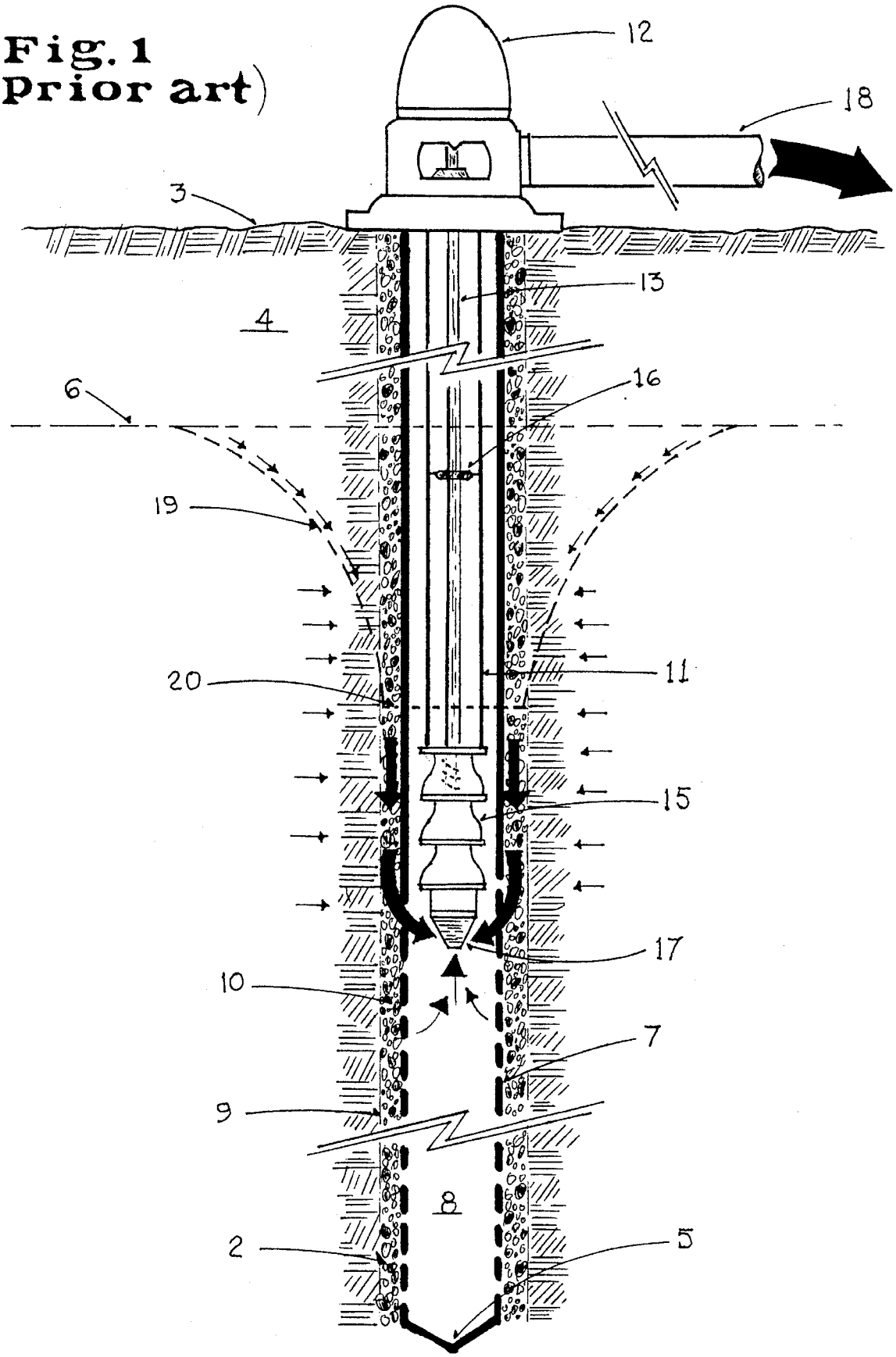
Fig. 1 (Prior art)
FIG. 1 is a cross-sectional and cut-away view of a typical prior art deep water well having a turbine pump.
Figure 2:
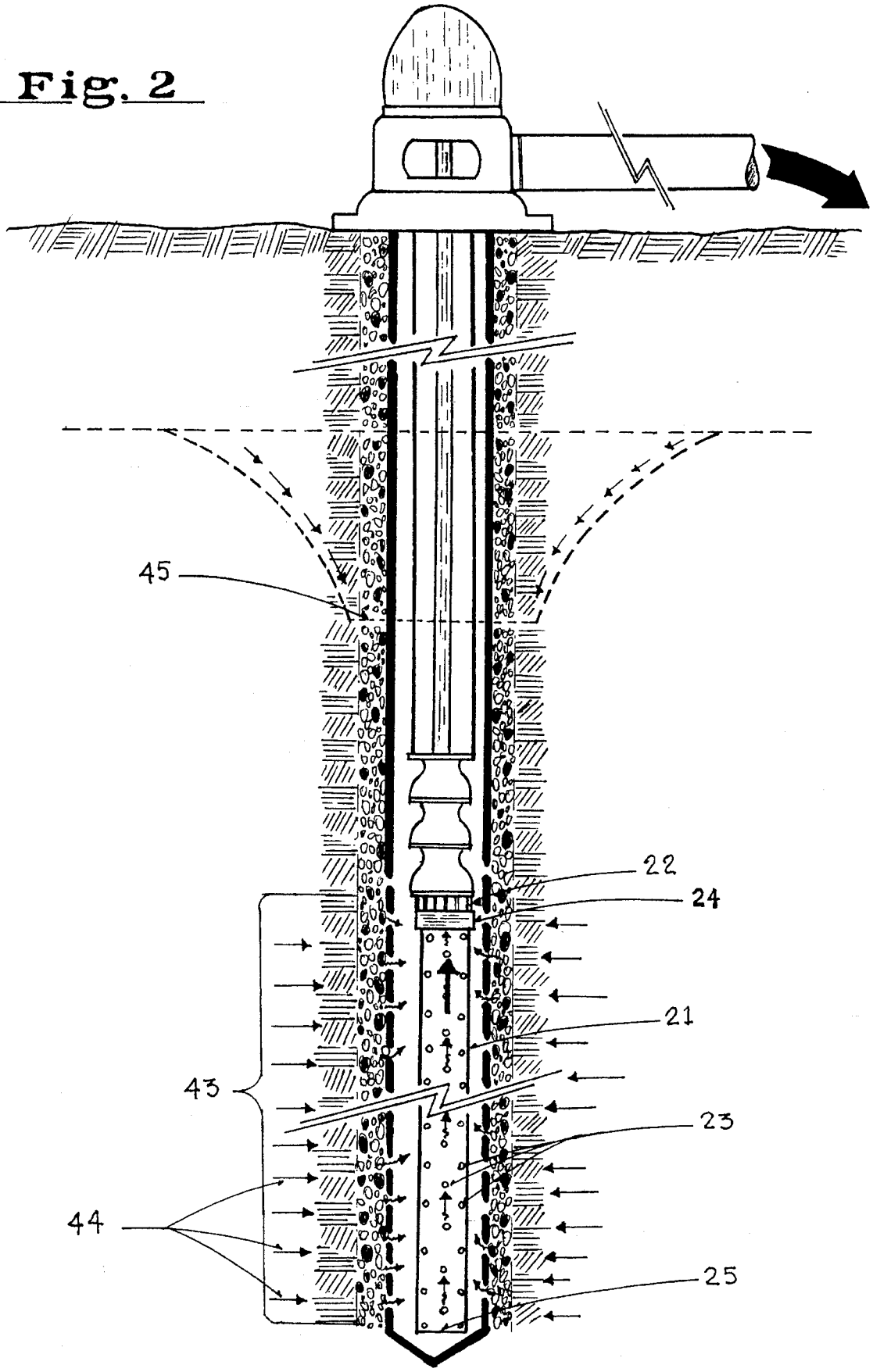
FIG. 2 is a cross-sectional and cut-away view of a deep water well having a turbine pump using the suction device of the invention.

Referring now to the drawing, there is shown in FIG. 2 a cross-sectional view of a deep water well pumping installation having many features in common with the prior art installation FIG. 1. The significant difference is however, the addition of a suctioning device 21 extending down from the intake port 22. The suctioning device is in the form of a one or more sections of tubular conduit having a series of spaced apart lateral admissors 23 which allow water to be drawn from the aquiferous geological formation at any depth traversed by the suction device. The top of the suction device is attached to the intake port using a threaded nipple or coupling 24. The admissors can be positioned anywhere on the surface of the conduit. However, they usually will extend around the periphery and down to a bottom end 25 of the suction device. The end may be open or partially or completely capped using a truncated admission cone.

Figure 4:
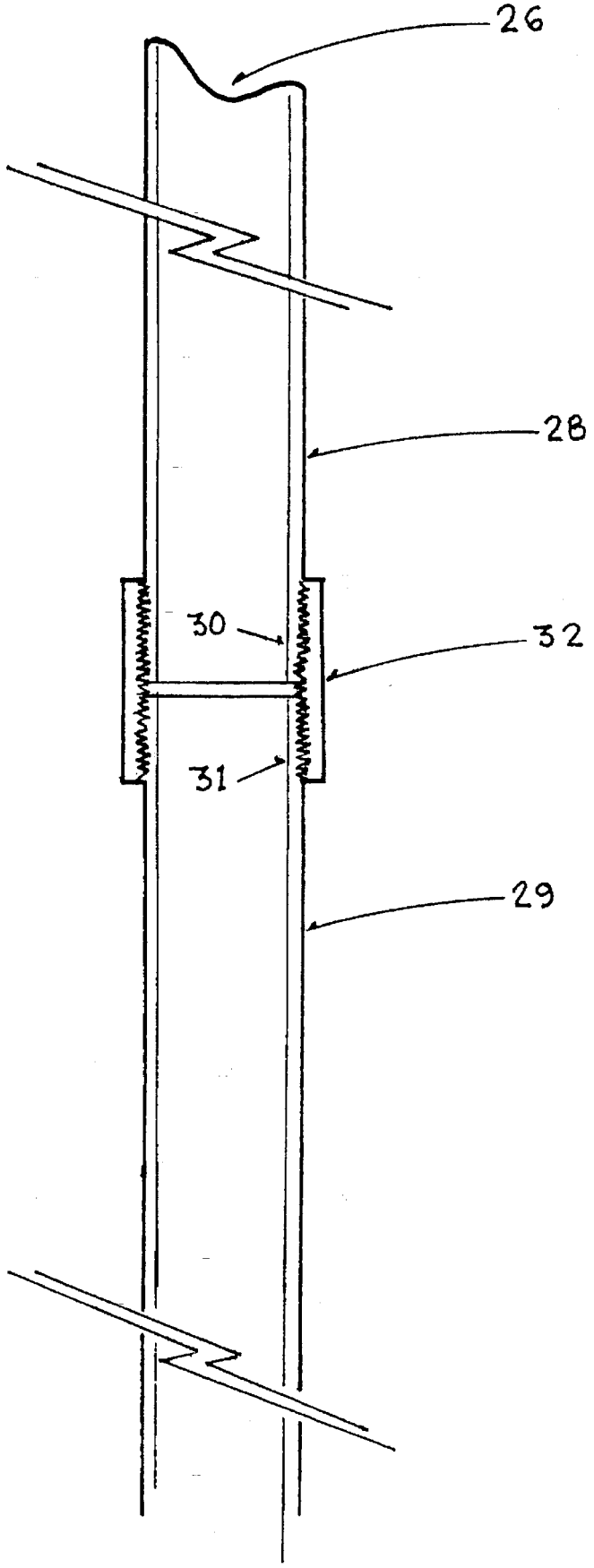
FIG. 4 is a cross-sectional view of the threaded ends of two sections of conduit joined by a threaded coupling.
Figure 9:
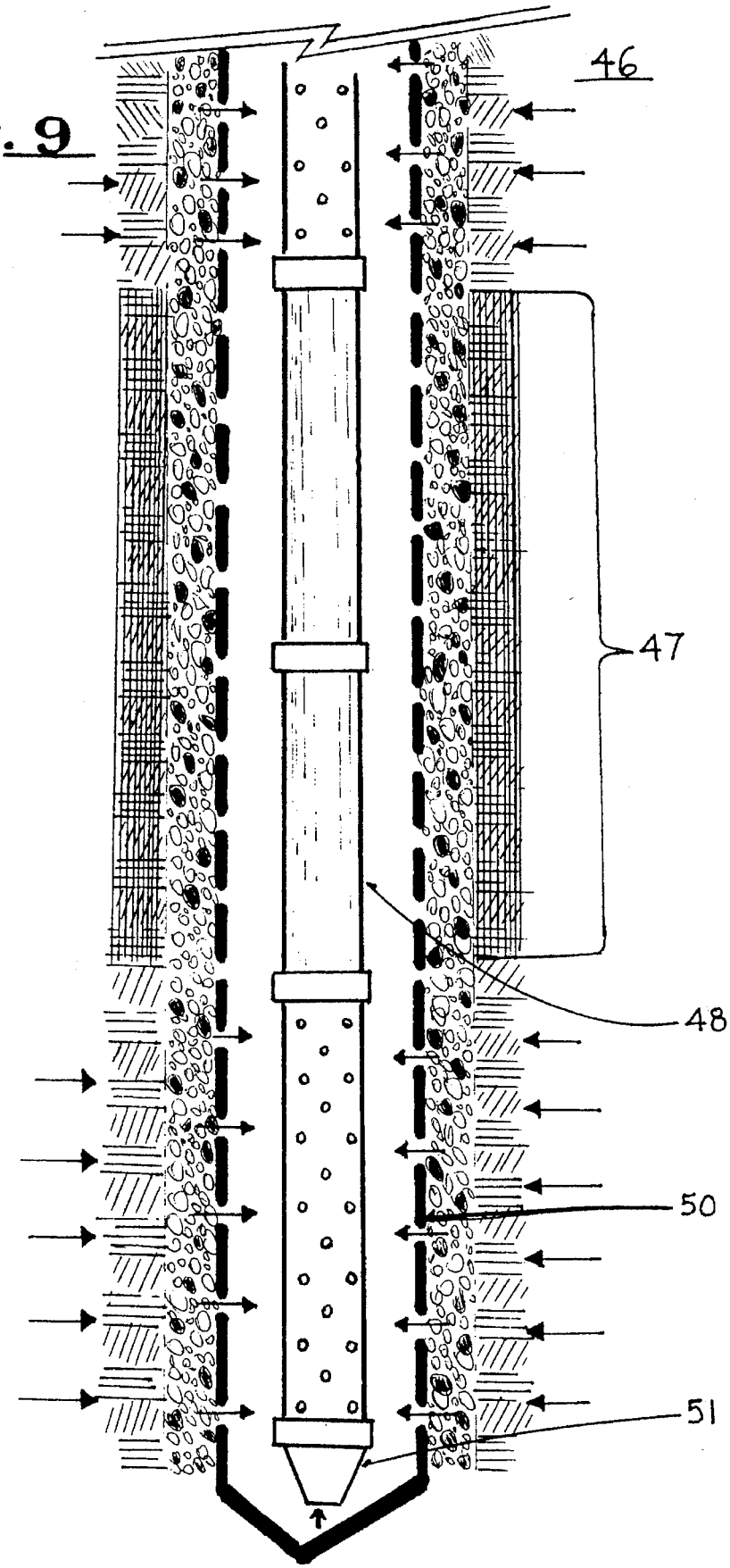
FIG. 9 is a perspective view of a portion of the suction device.

FIG. 9 and 4 show that the suction device 26 is generally cylindrical in shape, with the plurality of admissors 27 distributed over its surface. The suction device can be made of steel, fiberglass, plastic such as polyvinyl chloride (PVC), polyethylene or acrylonitrile butadiene styrene (ABS) or any other strong, durable material.

The suction device may be made in detachable sections 28, 29 to make handling easier, reduce costs and to allow for wells having pumping chambers of different lengths. Means for attaching the sections can be in the form of threaded ends 30,31 which can be attached into a threaded coupling 32. This threading can also be used as a means for attaching the suction device to the intake port. Other means for attaching, well known in the art such as welding may be used without departing from the invention.

Figure 7:
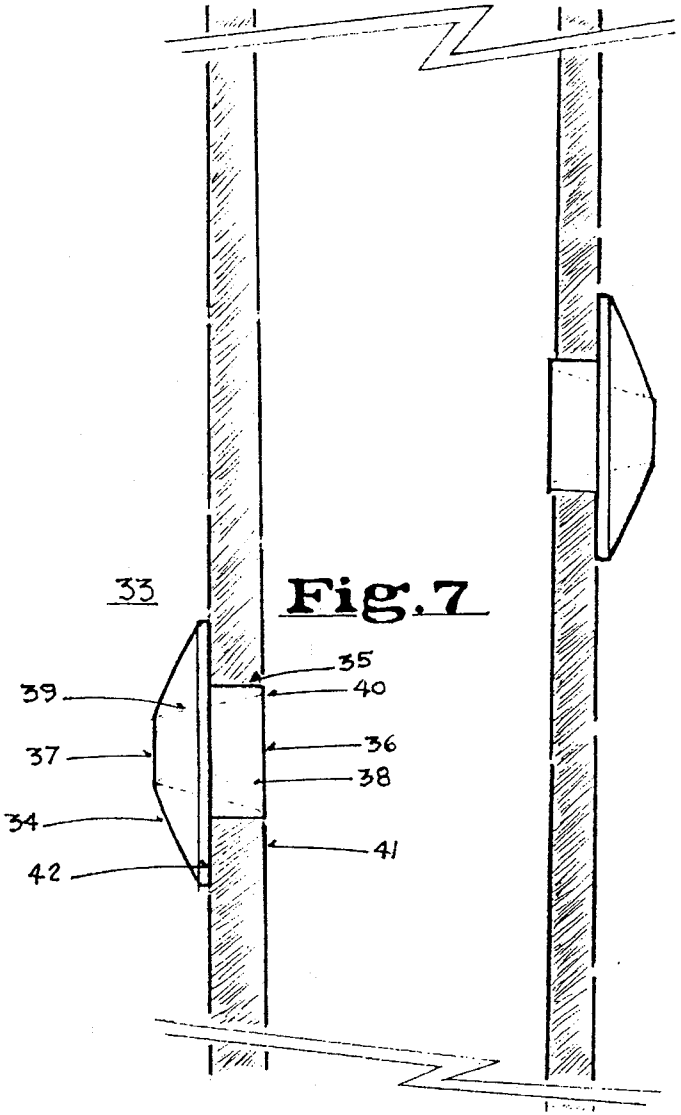
FIG. 7 is a side view of a water guiding admissor.
Figure 5:
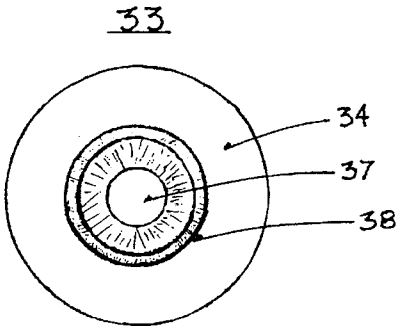
FIG. 5 is a front view of a water guiding admissor.
Figure 6:
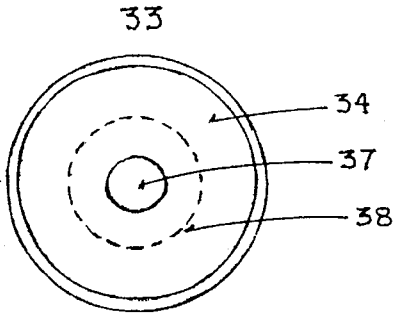
FIG. 6 is a top view of a water guiding admissor.
Figure 8:
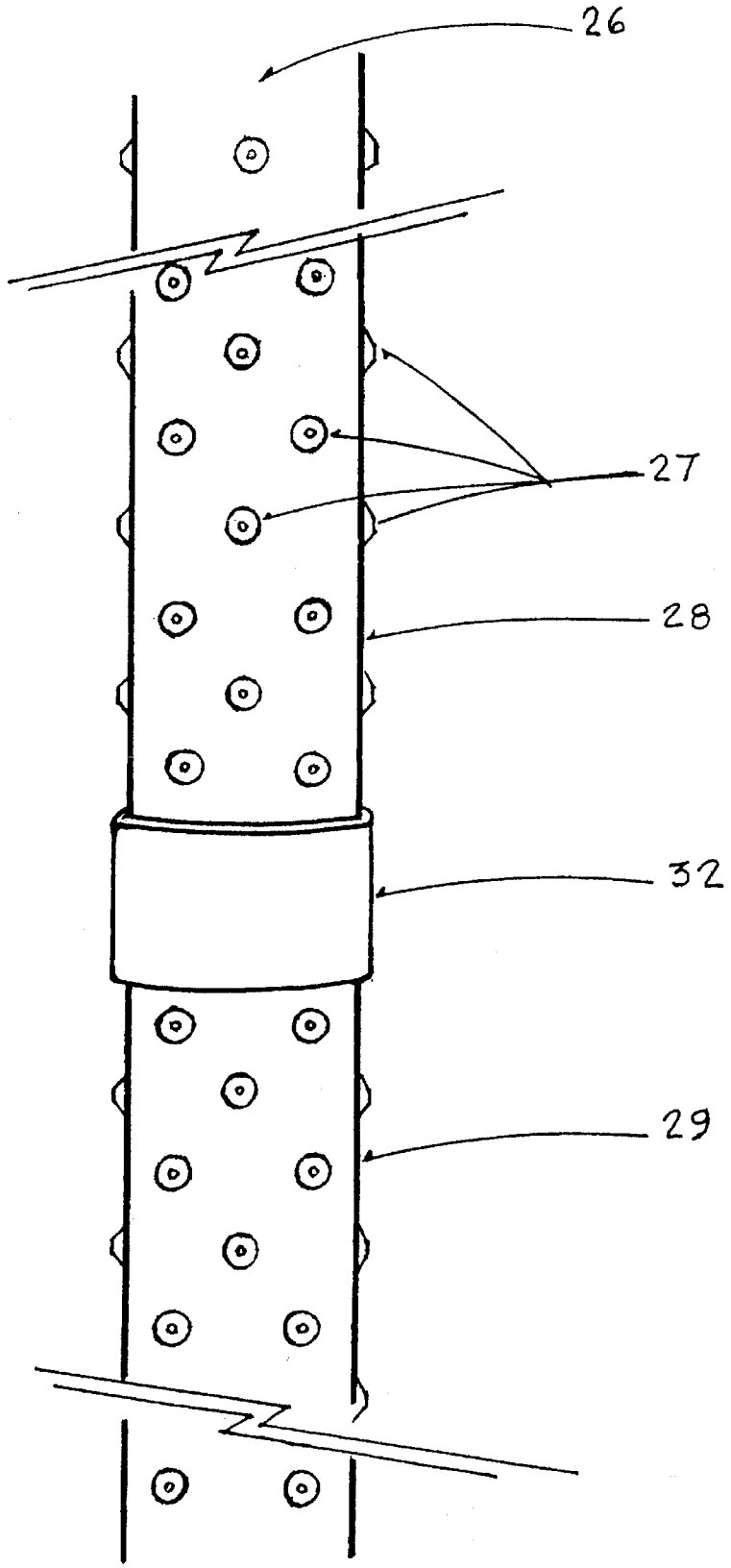
FIG. 8 is a cross-sectional view of a water guiding admissor.

The admissors disclosed in the preferred embodiment are designed to guide the water toward the intake port and to reduce the friction caused by contraction of the flow through the orifice of the admissor. FIGS. 5–8 show a preferred design of one such admissor. FIG. 5 shows a front view; FIG. 6 shows a top view; FIG. 7 shows a side view, and FIG. 8 shows a cross-sectional view taken along line 7—7. The admissor 33 is formed by a generally disk shaped body 34 having a generally cylindrical rearward projection 35 which is sized and dimensioned to penetrate a substantially circular hole in the wall of the conduit. The admissor may be pressed into place and held through friction or may be attached to the conduit through other means such as glue. An orifice 36 pierces through body from front to back at substantially the center of the disk. The orifice connects a forward opening 37 with a rearward opening 38. The forward opening is generally conical in shape with a gradual inward bevel 39. The rearward opening is only partially conical with an inward bevel on a top section 40 and little or no bevel on a bottom section 41 so as to direct the flow of water toward the intake port with less friction. The body has a cylindrically concave back surface 42 dimensioned to bear flat against the curved outer wall of the cylindrical tubular conduit. The admissors can be made of steel, fiberglass, plastic such as polyvinyl chloride (PVC), polyethylene or acrylonitrile butadiene styrene (ABS) or any other strong, durable material. This admissor design reduces friction due to contraction of the flow entering the suction device.

Although admissors which direct the flow toward the intake port are the preferred approach, the term "admissors" can refer simply to perforations through the wall of the conduit. These perforations can be of various geometric shapes as long as they provide for the free flow of the volume of water for which the suction device is designed.

Referring back to FIG. 2, during operation, the suction generated by the pump is distributed along the length of the suction device 21 instead of being concentrated just below the intake port 22 as is the case in the prior art installation. Water enters the suction device along its entire length 43 from a portion of the well called the pumping chamber. As a result, the hydraulic flow from different depths 44 of the geological formation into the well becomes uniform with less velocity. The reduction in velocity is directly proportional to a reduction in the dragging energy of the pump, and in the removal of particles from the geological formation. Although the volume of water entering a given admissor over a given time period is small, the combined apertures allow for an increase in volume over a given time period at the intake port. Of course the combined flow through all the apertures is substantially equal to the flow into the intake port or discharge tube.

The slower, more uniform flow also results in a much higher dynamic or pumping level 45 than that of the prior art installation. This elevation of the dynamic level is directly proportional to the length of the suction device and to the capacity of the aquifer at those depths traversed by the device. It must be mentioned that the dynamic level elevation is more noticeable in short depth aquifers (less than 130 feet). In very deep wells the increase may be as low as 1.5%.

The admissors have dimensions and spacings calculated to distribute the suction along the length of the conduit.

Factors guiding the specific selection of dimensions and spacings depend on the particular problems of a given well and the volume of water desired. Naturally, the sum of flow through the admissors should equal the flow required by the pump. To take full advantage of the invention, it is important to calculate the number of admissors, their diameter and spacing according to the maximum length the conduit can attain, namely, the distance from the intake port to the bottom of the well.

However, in order to have a suitable design, the suction device must be long enough to distribute the flow required by the pump along the aquifer. For example, if the pump has a flow rate of 571 gallons per minute, and the suction device is to be 177 feet long, water will be requested from the aquifer at a rate of 10.4 gallons per minute for each yard of perforated casing available between the intake port and the bottom of the well.

The sizes and spacings can then be adjusted for varying aquiferous layer strata which may give up more water than other strata.

The conduit can terminate at any depth below the intake port, but will usually extend to the bottom of the well to most distribute the suction.

Certain admissors can be omitted at certain levels in order to selectively avoid pumping from salty or otherwise contaminated layers. FIG. 10 shows a cross-section and cutaway view of the bottom of a deep water well where there exists in the geological formation 46 a contaminated portion 47. In order to avoid suctioning water from this depth, the suction device 48 traversing this depth has no admissors. This may be accomplished simply by incorporating an un-perforated section of conduit as part of the suction device as shown, or selectively providing admissors on only parts of sections. Further, in order to isolate this zone from contaminating adjacent zones, obturators such as packers 49, or other ring shaped structures will fill the annular space between the suction device and the casing 50. Naturally, the suction device should have enough admissors of sufficient size distributed along the good water quality depths so as to provide an adequate flow for the pump. FIG. 9 also shows that an admission cone 51 may be attached to the bottom end of the suction device, to regulate the admission of water, if any, into the deepest section of conduit.

The advantages of this system include: cleaner, better quality water; more water throughput for a given aquiferous area; and, less wear and tear of the pumping installation equipment, thereby reducing maintenance and increasing the useful lifetime of the installation.

Cleaner, less silty water benefits both municipal and agricultural concerns. Distribution equipment components such as pipelines, flow meter gauges and valves are subjected to less wear and the water itself will require less processing such as filtering. Reducing the mineral content in water used for irrigation reduces the volume needed to properly grow most plants.

Figure 3:
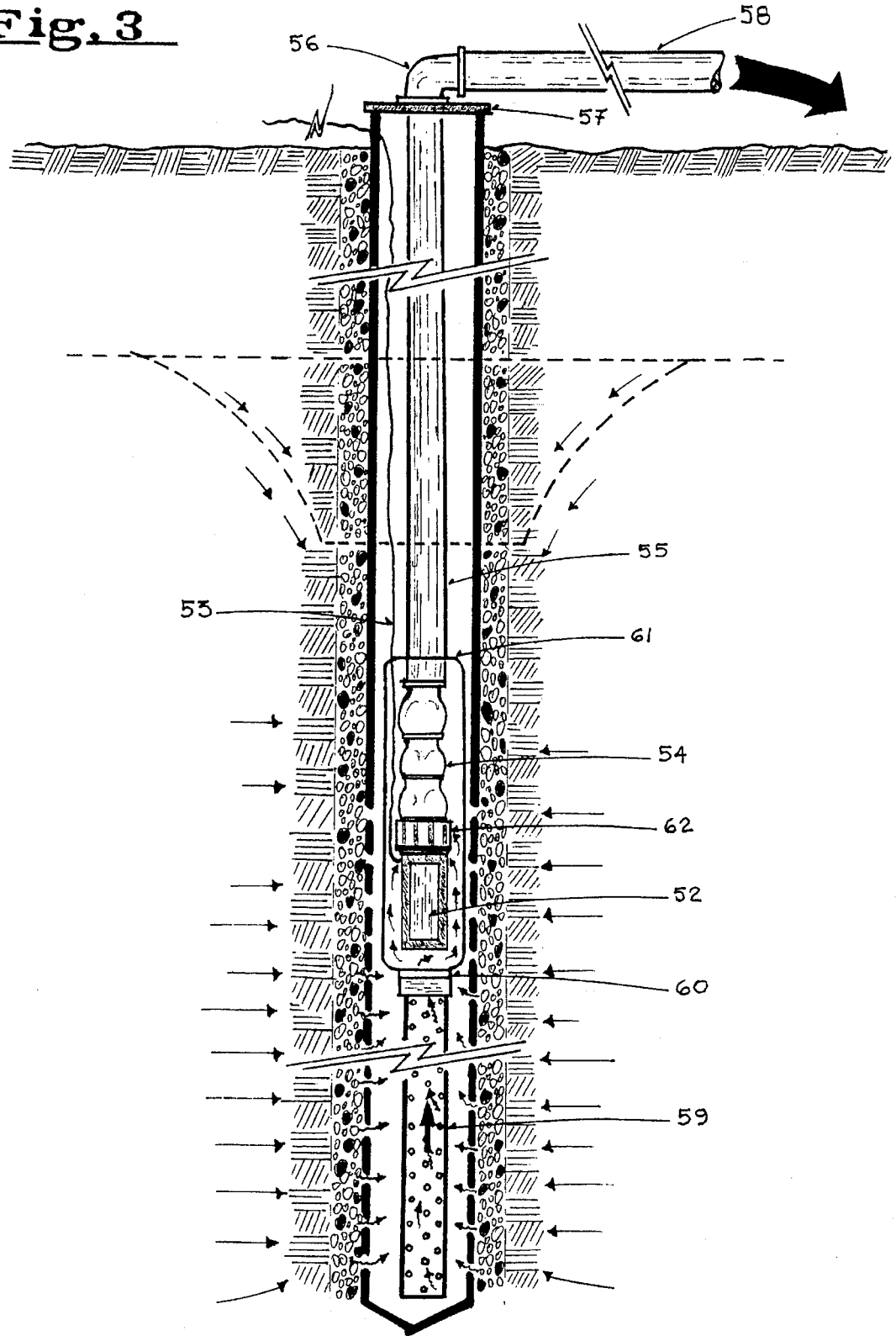
FIG. 3 is a cross-sectional and cut-away view of a deep water well according to the invention which uses a submersible type pump.

Another advantage of this invention is that it is easily adaptable to virtually any type of deep water well pumping equipment currently available. FIG. 3 shows the invention is equally applicable to a new generation of pumping equipment wherein the motor 52 is submerged within the well itself. Power to the motor is supplied by an electric power cable 53 which is sized and insulated according to the type and amount of current drawn by the motor and the depth of the motor. A shaft from the motor extends up to the impellers which are still located in bowls 54 which connect to a tube 55 leading to a 90 degree elbow 56 which is attached to a steel plate 57 atop the casing. The elbow leads to a discharge pipe 58.

As with the above ground turbine pump arrangement, the suction device 59 is used to provide a more uniform flow of water from the aquiferous geological formation along the depth of the pumping chamber. Water enters through admissors in the suction device which is connected to the threaded nipple extending from the inlet port 60 of a capsule or vessel 61 which surrounds the motor, the bowls and the suction port 62. By placing the motor within the vessel, water passes over the motor's outer housing thereby cooling it during operation. This prolongs the lifetime of the motor and increases efficiency. Also, the pump does not require expensive maintenance. Prior to the invention, suspended solids in the water would quickly wear on the structures of the submersible pump.

To maintain clarity of terminology, the inlet port to the vessel can be referred to as the intake port of the pump.

Although the preferred embodiment of this invention has been described using the currently popular turbine pump arrangements, the invention is capable of benefiting other types of pumps as well, including suction, pneumatic and piston driven fluid pumps.

While the preferred embodiments of the invention have been described, modifications can be made and other embodiments may be devised without departing from the spirit of the invention and the scope of the appended claims.

What is claimed is:

1. In a deep water well pumping device for extracting water from an aquifer geological formation, said pump having a conduit connected to an intake port and extending into a hole, said conduit having a plurality of apertures, the improvement comprising:

A plurality of admissors mounted on apertures of said conduit; each o said admissors having a first portion and a second portion, the diameter of said first portion is larger than the diameter of the second portion of said admissor; The openings of said first portion and second portion being beveled outwardly with a conical shape about a center of said opening.

2. The improvement of claim 1, wherein said admissors are of equal size, and symmetrically spaced apart around and along said conduit.

3. The improvement of claim 2, wherein said conduit has an admission cone at the bottom end.

4. The improvement of claim 3, wherein the accumulative volume of water flow entering through said admissors, is equal to the capacity of the volume of said intake port.

* * * * *